US010624473B1

(12) United States Patent
Tsai

(10) Patent No.: US 10,624,473 B1
(45) Date of Patent: Apr. 21, 2020

(54) PICTURE FRAME

(71) Applicant: Yu-Seng Tsai, Hsinchu (TW)

(72) Inventor: Yu-Seng Tsai, Hsinchu (TW)

( * ) Notice: Subject to any disclaimer, the term of this patent is extended or adjusted under 35 U.S.C. 154(b) by 0 days.

(21) Appl. No.: 16/250,767

(22) Filed: Jan. 17, 2019

(51) Int. Cl.
*A47G 1/06* (2006.01)

(52) U.S. Cl.
CPC ..... *A47G 1/06* (2013.01); *A47G 2001/0677* (2013.01)

(58) Field of Classification Search
CPC ..... A47G 1/06; A47G 2001/0677
See application file for complete search history.

(56) References Cited

U.S. PATENT DOCUMENTS 2,806,309 A * 9/1957 Goldberg ..... G03B 21/64 40/706
3,681,867 A * 8/1972 Bilodeau ..... A47G 1/06 40/759
3,745,680 A * 7/1973 Faust ..... A47G 1/06 40/732
3,918,187 A * 11/1975 Vogele ..... G09F 1/12 40/781
4,270,288 A * 6/1981 Sulzer ..... G09F 1/12 40/661
4,432,152 A * 2/1984 Daenen ..... A47G 1/065 40/762
4,736,539 A * 4/1988 Dickinson ..... B60R 11/00 40/200
5,012,601 A * 5/1991 Garland ..... A47G 1/06 40/718
7,175,242 B2 * 2/2007 Lee ..... A47F 3/005 312/265.5
2017/0035221 A1 * 2/2017 Huff ..... A47G 1/06

* cited by examiner

*Primary Examiner* — Cassandra Davis
(74) *Attorney, Agent, or Firm* — Chun-Ming Shih; HDLS IPR Services

(57) ABSTRACT

A picture frame used to receive a painting includes a front cover and a rear cover. The front cover has a front side and a surrounding wall enclosing the front side. The front cover forms a rear opening opposite to the front side and the front side is provided with a window. The rear cover is snapped around the rear opening of the front cover. The rear cover protrudes towards the window to form a rear frame in the front cover. The paining is clamped between the front cover and the rear frame and is exposed in the window.

7 Claims, 11 Drawing Sheets

PICTURE FRAME

BACKGROUND OF THE INVENTION

Field of the Invention

The present invention relates to a picture frame, and in particular, to a snapping-type picture frame.

Description of Related Art

The existing picture frames are mainly made of wood or metal. The painting has to be fixed on the sketchpad first and then the picture frame is assembled for the subsequent framing. Thus, a professional worker is required for framing, which is generally difficult to perform for a layman. Besides, the wooden or metal picture frame is rather heavy and is liable to fall in case of insufficient strength of the hook or the hanging wire. As such, the user may suffer inconvenience when hanging the picture frame.

In view of foregoing, the inventor pays special attention to research with the application of related theory to overcome the above disadvantages regarding the above related art.

SUMMARY OF THE INVENTION

The present invention provides a snapping-type picture frame.

The present invention provides a picture frame used to receive a painting. The picture frame comprises a front cover and a rear cover. The front cover has a front side and a surrounding wall enclosing the front side. The front cover forms a rear opening opposite to the front side and the front side is provided with a window. The rear cover is snapped around the rear opening of the front cover. The rear cover protrudes towards the window to form a rear frame in the front cover. The paining is clamped between the front cover and the rear frame and is exposed in the window.

In the picture frame of the present invention, the rear cover has a back plate which covers part of the rear opening. The rear frame has an annular shape and a recess is formed in a range encircled by the rear frame on the back plate.

In the picture frame of the present invention, two rear covers spaced apart are individually snapped at a side opposite to the rear opening. Two rear frames of the two rear covers are disposed opposite to each other. The two rear frames and the surrounding wall form a recess.

In the picture frame of the present invention, the rear cover and the surrounding wall are nested together. The surrounding wall encloses the rear cover.

In the picture frame of the present invention, an adhesive part is disposed on the outer side of the back plate.

In the picture frame of the present invention, a plurality of hook parts is disposed protruding from the inner side of the surrounding wall and the hook parts are individually snapped to the edge of the rear cover. A plurality of slots snapped correspondingly to the hook parts is disposed on the edge of the rear cover.

In the picture frame of the present invention, a plurality of hook parts is disposed protruding from the edge of the rear cover and the hook parts are individually snapped to the inner side of the surrounding wall. Each hook part is connected to the edge of the rear cover through a flexible arm. The flexible arm extends from the rear cover to the front cover and is reversed to have a U-like shape. The hook part is protruded and formed at a side of one end of the flexible arm.

In the picture frame of the present invention, the inner side of the surrounding wall and the edge of the rear cover are individually provided with a plurality of positioning latches which is latched to each other correspondingly.

The picture frame of the present invention is formed by mutual snapping engagement of the front cover and the rear cover. The user just places the painting into the front cover and then snaps the rear cover into the front cover to complete the framing easily and quickly. In addition, the picture frame of the present invention is quite light for easy hanging on and adhesion to the wall.

DETAILED DESCRIPTION OF THE INVENTION

Figure 1:
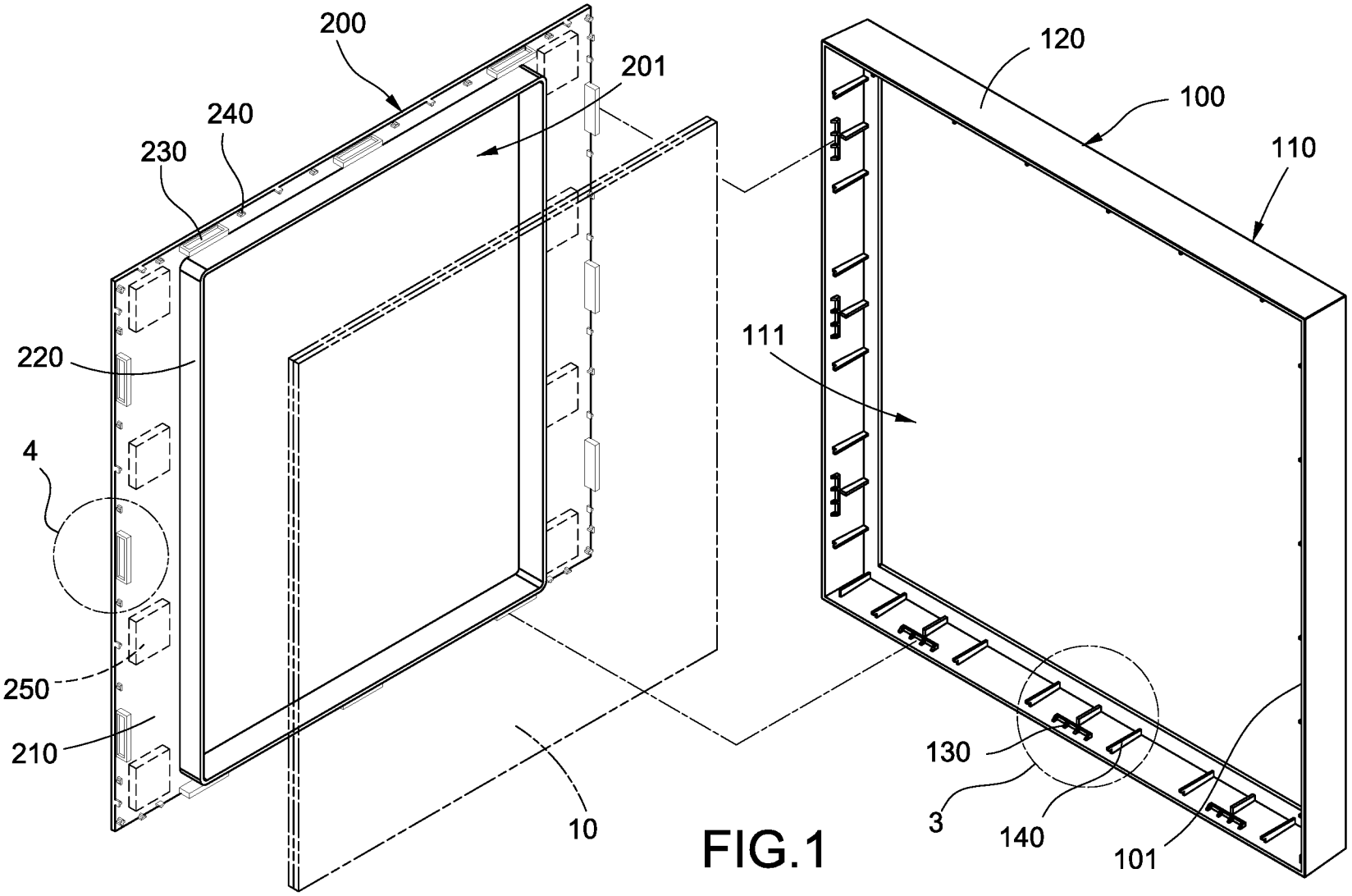
FIG. 1 is an exploded perspective view of the picture frame according to the first embodiment of the present invention.
Figure 2:
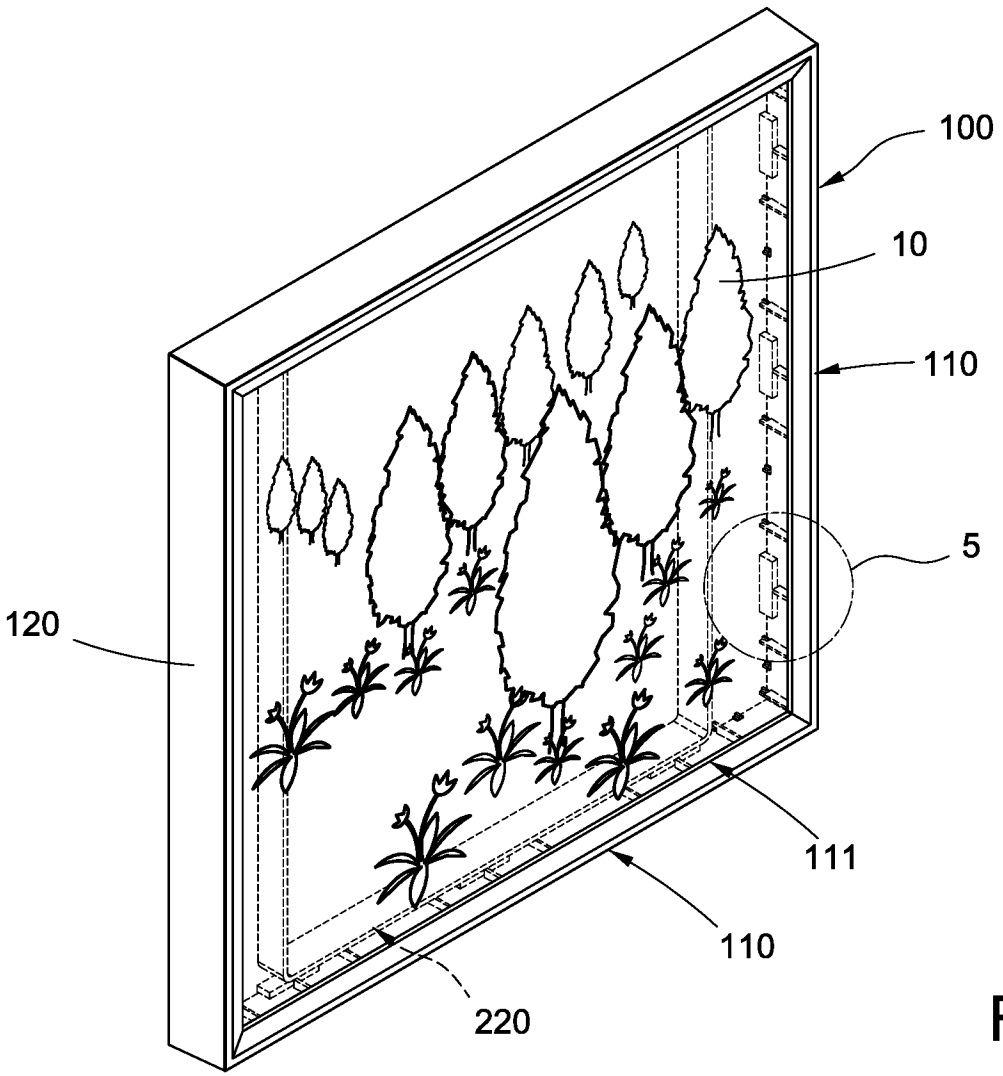
FIG. 2 is a schematic view of the picture frame according to the first embodiment of the present invention in a use state.
Figure 4:
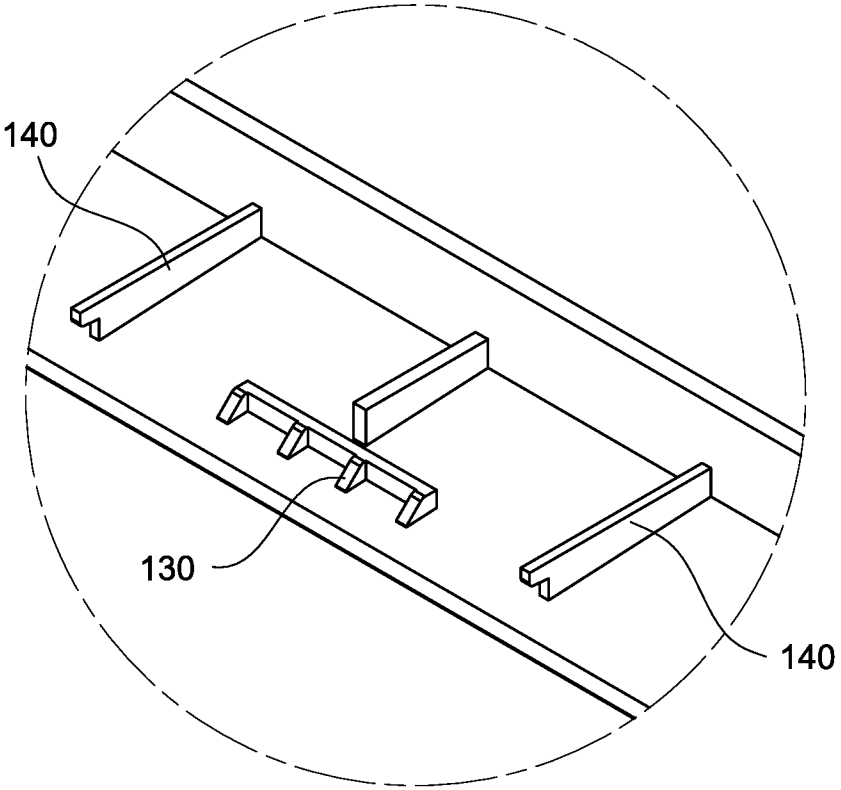
FIGS. 3 and 4 are the local enlarged views of FIG. 1.
Figure 3:
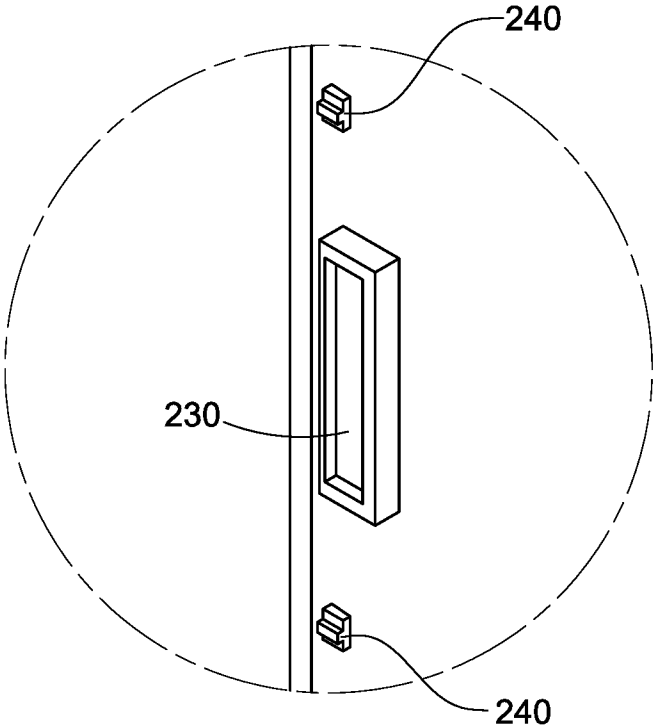
Figure 5:
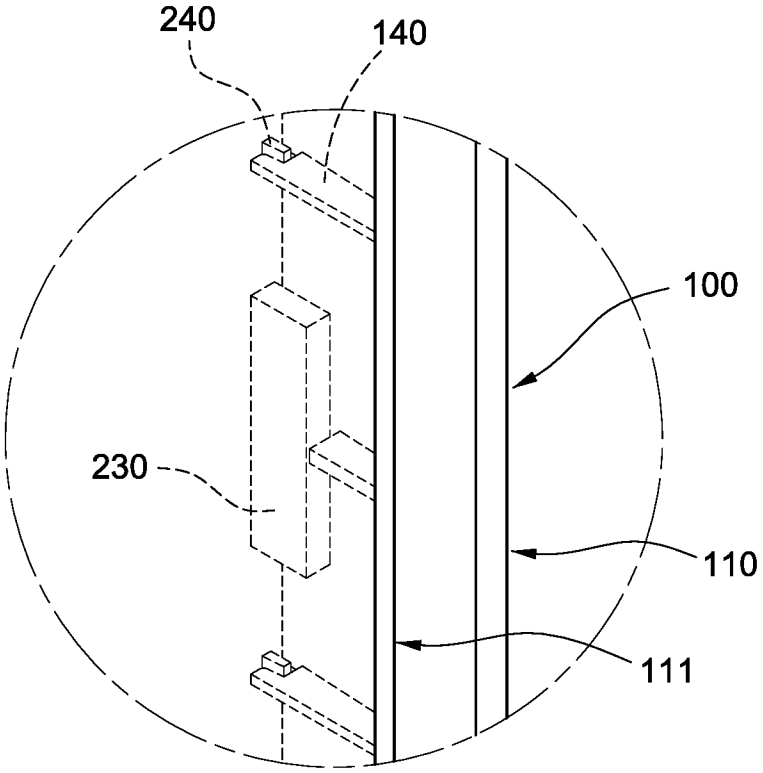
FIG. 5 is the local enlarged view of FIG. 2.

Please refer to FIGS. 1-5. The first embodiment according to the present invention provides a picture frame which is used to receive a painting 10. In the current embodiment, the picture frame preferably comprises a front cover 100 and a rear cover 200. The front cover 100 and the rear cover 200 are both plastic shells.

The front cover 100 has a front side 110 and a surrounding wall 120 enclosing the front side 110. The front cover 100 forms a rear opening 101 opposite to the front side 110. The front side 110 is provided with a window 111. The thickness of the picture frame formed by the surrounding wall 120 makes the picture frame weightier and more beautiful.

The rear cover 200 is snapped around the rear opening 101 of the front cover 100. The rear cover 200 protrudes towards the window 111 to form a rear frame 220 in the front cover 100. The front side of the painting 10 is disposed corresponding to the window 111; the rear frame 220 supports the back side of the painting 10. Thus, the paining 10 is clamped between the front cover 100 and the rear frame 220 to be exposed in the window 111. In the current embodiment, the snapping engagement regarding the front cover 100 and the rear cover 200 is detailed below.

The rear cover 200 has a back plate 210 which covers part of the rear opening 101. The rear cover 200 and the surrounding wall 120 are nested together; the surrounding wall 120 encloses the rear cover 200. In the current embodiment, the rear frame 220 has an annular rectangular shape and a rectangular recess 201 is formed in a range encircled by the rear frame 220 on the back plate 210.

A plurality of hook parts 130 is disposed protruding from the inner side of the surrounding wall 120; the hook parts are individually snapped to the edge of the rear cover 200. In particular, a plurality of slots 230 snapped correspondingly to the hook parts 130 is disposed on the edge of the rear cover 200. The hook part 130 has a reversed-hook shape and has a tip 131, a hook portion 132, and a slope 133 connected between the tip 131 and the hook portion 132. The tip 131 of the hook part 130 is disposed towards the window 111. When the rear cover 200 is snapped to the rear opening 101 of the front cover 100, the tip 131 enters the rear opening 101 first and the slope 133 is pressed against the front cover 100 such that the hook part 130 deforms elastically to allow the hook portion 132 to enter the rear opening 101. When the hook portion 132 moves into the corresponding slot 230, the hook portion 132 snapped to the slot 230 prevents the rear cover 200 from being detached from the front cover 100.

The inner side of the surrounding wall 120 and the edge of the rear cover 200 are provided with a plurality of positioning latches 140/240 which is disposed correspondingly. When the positioning latches 140 on the inner side of the surrounding wall 120 are pressed against the corresponding positioning latches 240 on the edge of the rear cover 200, the back plate 210 of the rear cover 200 is aligned with the rear opening 101 of the front cover 100 by means of the relative position determined between the front cover 100 and the rear cover 200. Thus, the rear cover 200 is kept from further moving into the front cover 100. In the current embodiment, preferably, the corresponding positioning latches 140/240 are pressed against each other to further be mutually embedded, but not limited to this.

Figure 6:
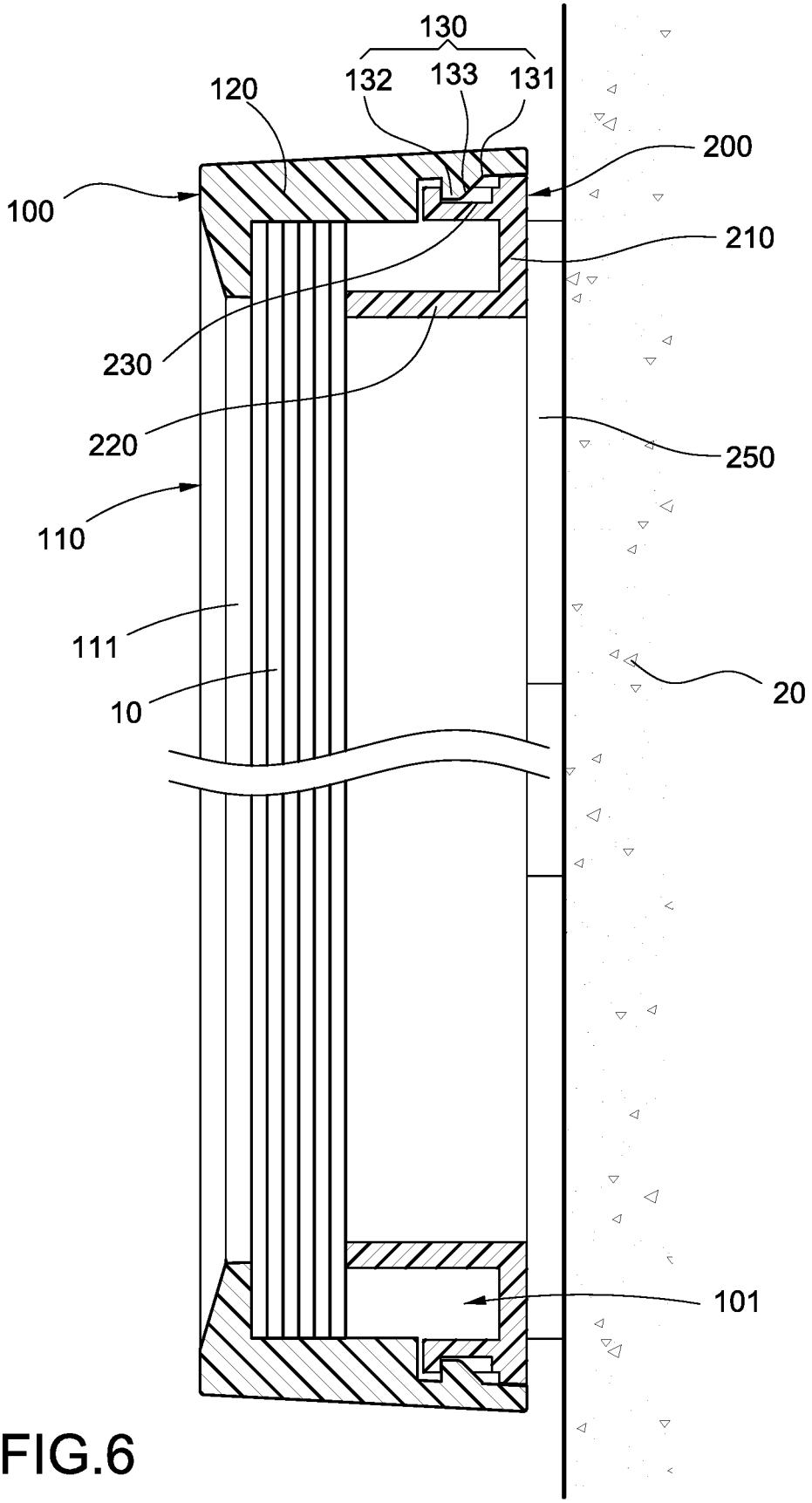
FIGS. 6 and 7 are the cross-sectional views of the picture frame according to the first embodiment of the present invention.
Figure 7:
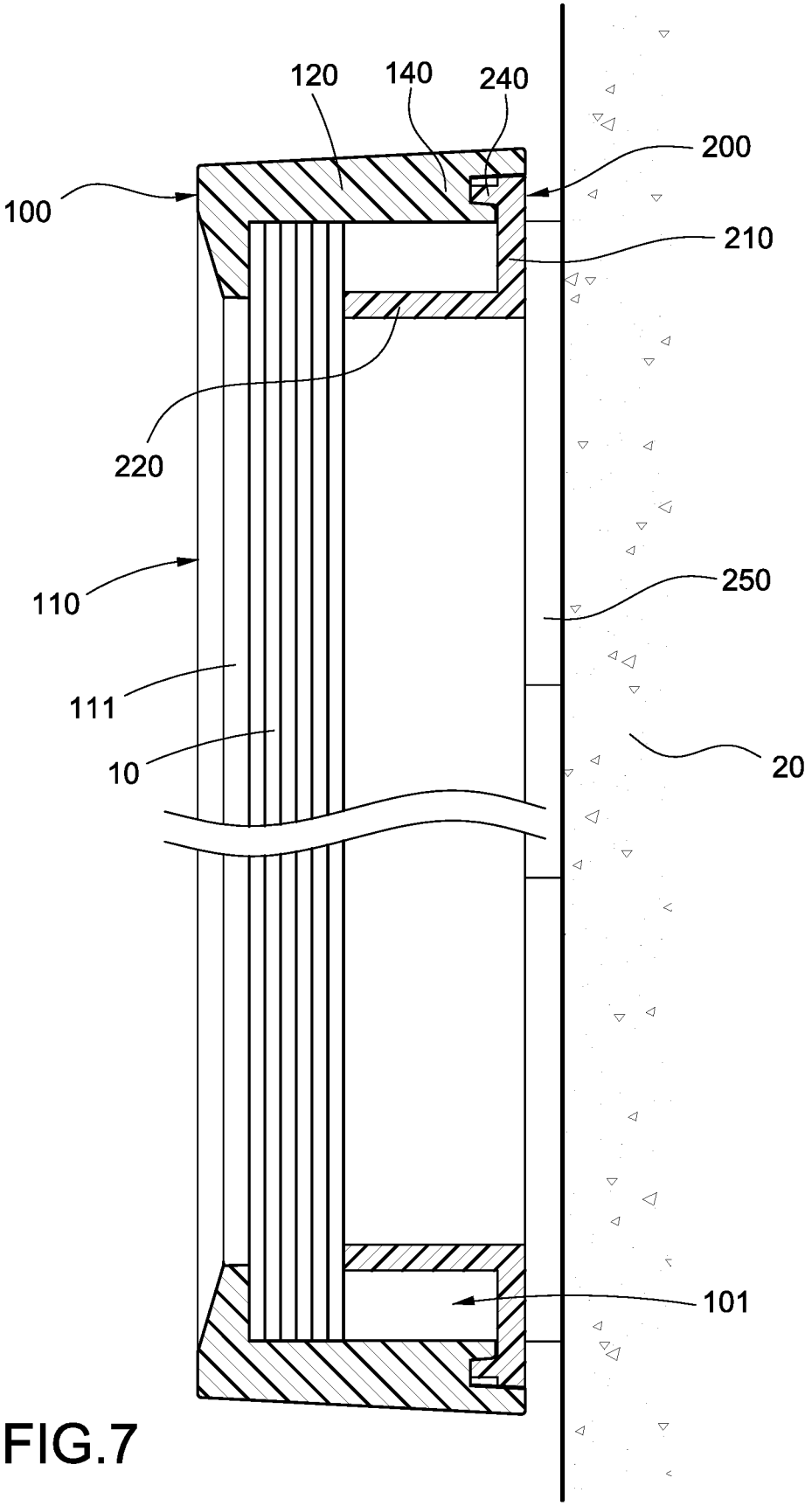

Please refer to FIGS. 1, 6, and 7. The outer side of the above-mentioned back plate 210 is provided with an adhesive part 250. In the current embodiment, the adhesive part 250 can be, for example, adhesive, Velcro, or clay. The picture frame of the present invention can be fixed and hung on the wall 20 by means of the adhesive part 250 sticking on the wall 20.

Figure 8:
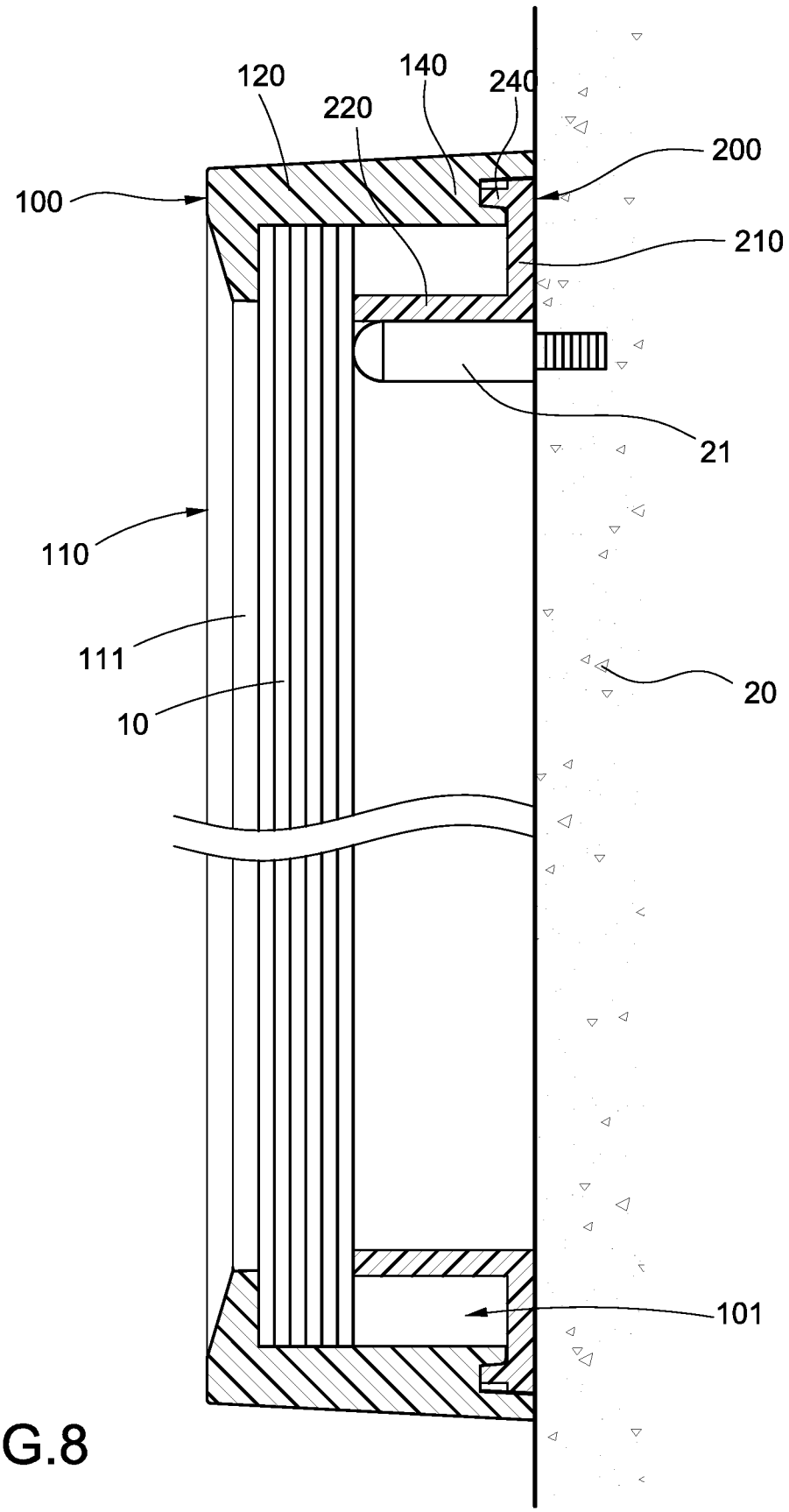
FIG. 8 is a schematic view of the picture frame according to the first embodiment of the present invention in another use state.

Please refer to FIG. 8. The recess 201 of the rear cover 200 can accommodate the hangers 21 (the hangers 21 can be simply implemented as nails) embedded in the wall 20. Then hangers 21 hook the edge of the recess 201 to hang the picture frame on the wall 20. The number of the hangers 21 can be one or more than one. Besides, the hangers 21 can hook at any corresponding position of the edge of the recess 201 according to the orientation of the painting 10. For example, two hangers 21 can be individually disposed to hook the inner sides of two corners of the recess 201. That is, two ends of one side of the recess 201. Thus, the hanging position of the picture frame can be positioned.

Figure 9:
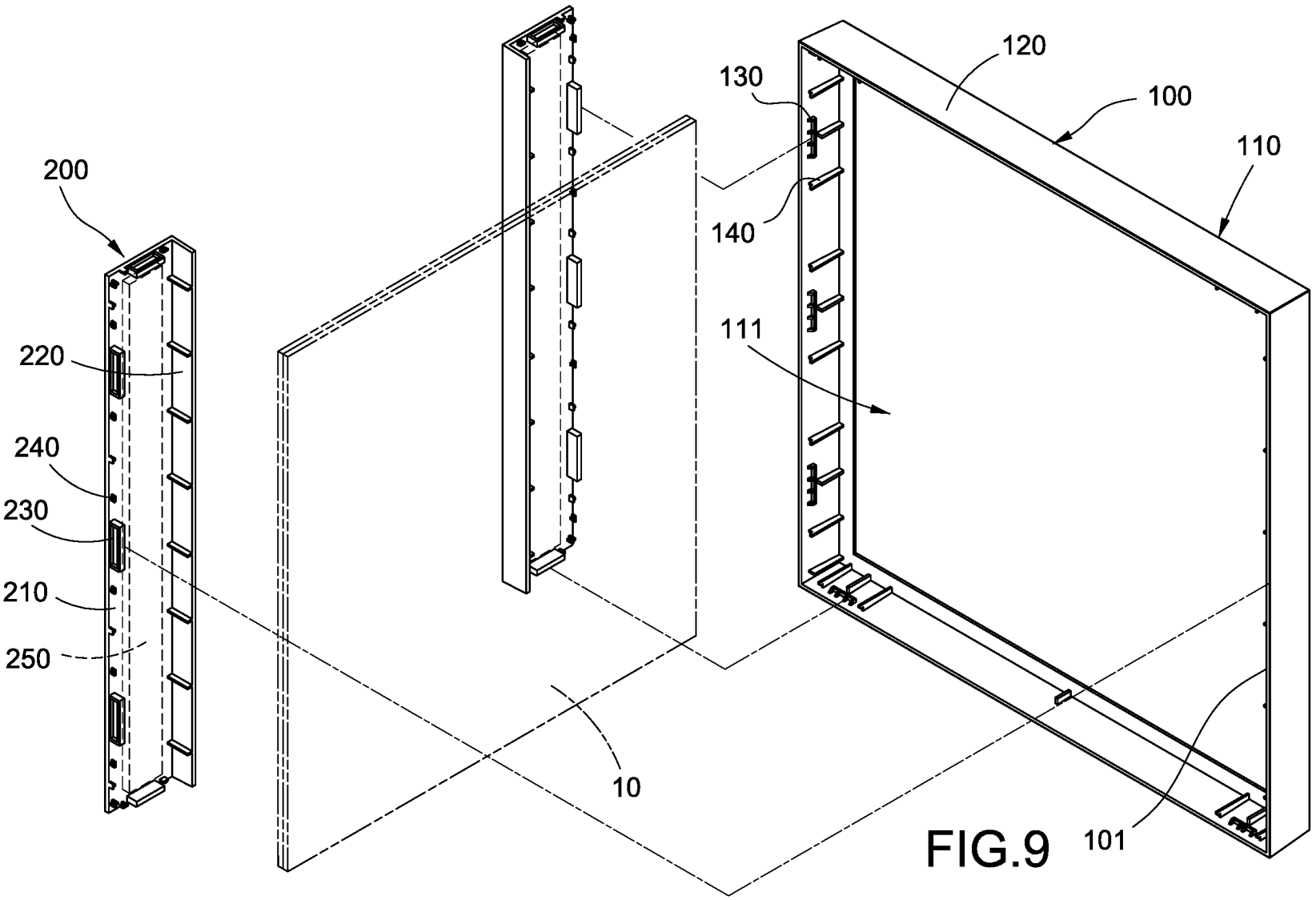
FIG. 9 is an exploded perspective view of the picture frame according to the second embodiment of the present invention.
Figure 10:
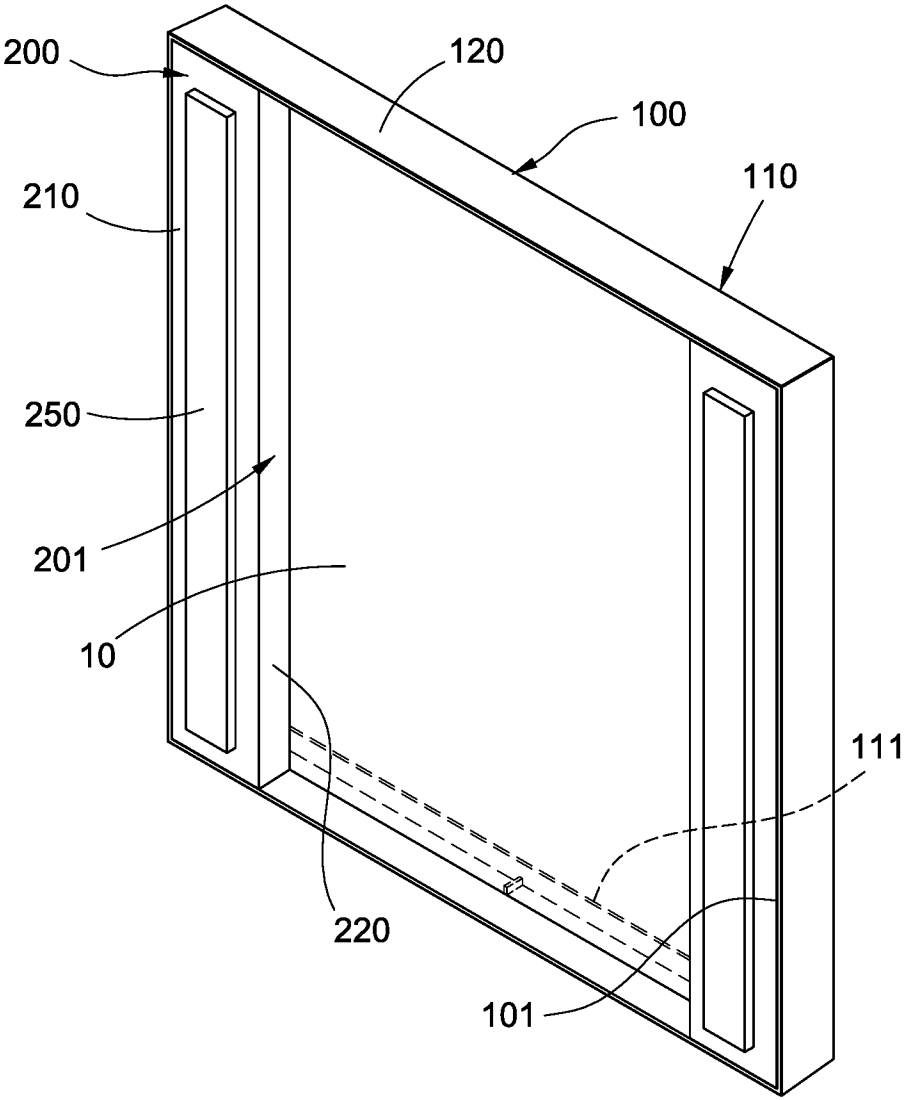
FIG. 10 is a perspective view of the picture frame according to the second embodiment of the present invention.

Please refer to FIGS. 9 and 10. The second embodiment of the present invention provides a picture frame which comprises a front cover 100 and a rear cover 200. In the picture frame of the second embodiment, the structure of the front cover 100 is identical to that of the first embodiment and is not described hear again. The difference between the first and the second embodiments will be detained below.

In the second embodiment, two rear covers 200 spaced apart are individually snapped at a side opposite to the rear opening 101. A rear frame 220 having a bar shape extends from each rear cover 200. Two rear frames 220 of the two rear covers 200 are disposed opposite to each other. In this way, a rectangular recess 210 is formed between the two rear frames 220 and the surrounding wall 120.

Figure 11:
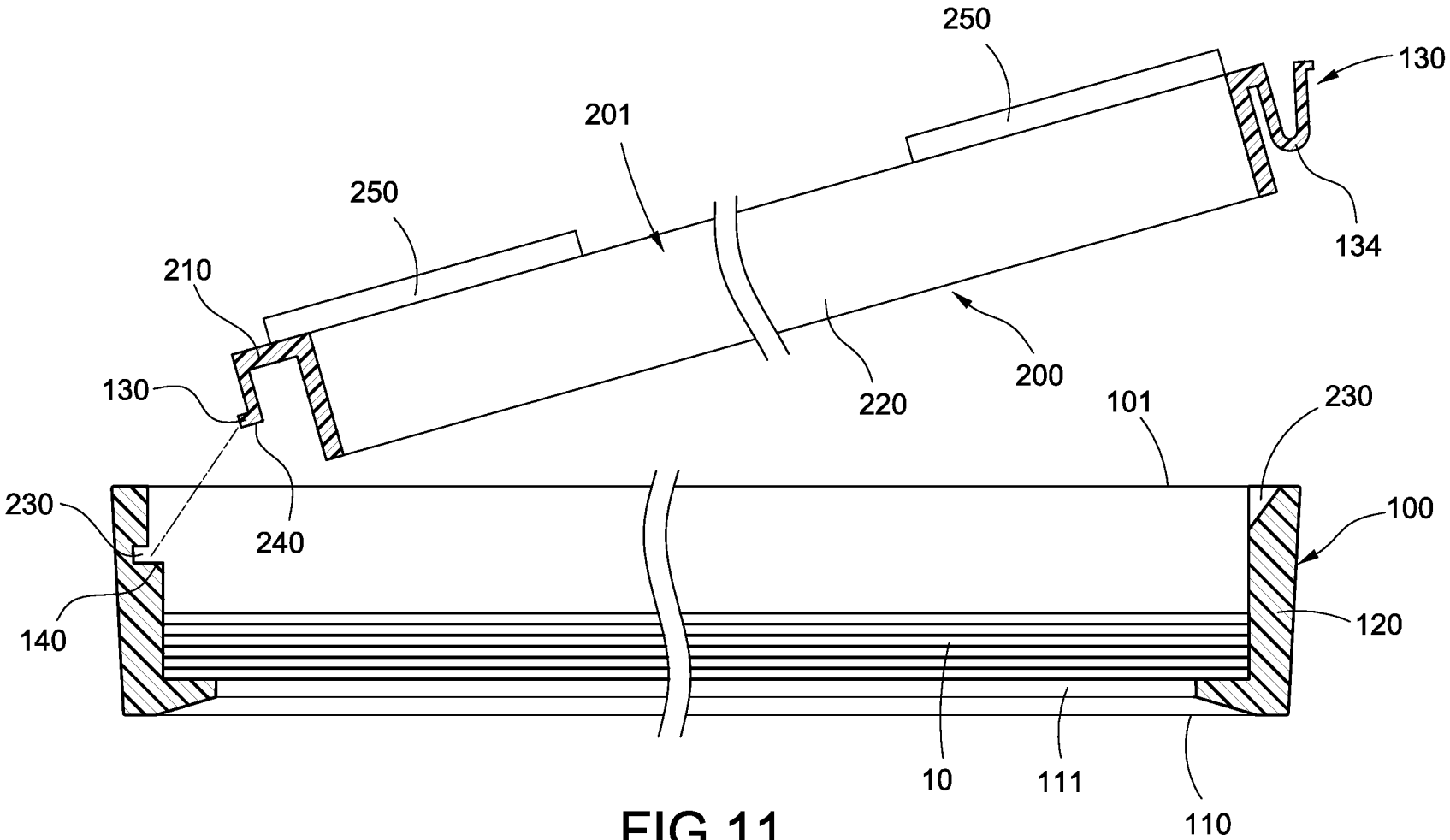
FIGS. 11 and 12 are the schematic views of the picture frame according to the third embodiment of the present invention.
Figure 12:
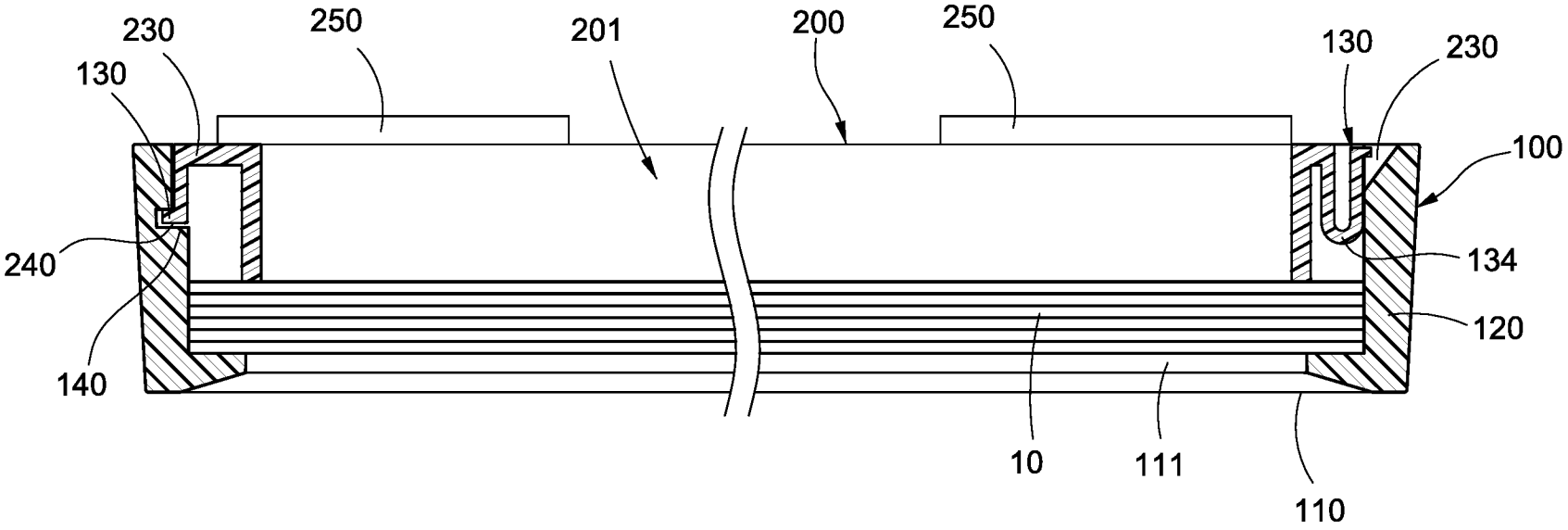

Please refer to FIGS. 11 and 12. The third embodiment of the present invention provides a picture which comprises a front cover 100 and a rear cover 200. In the picture frame of the third embodiment, the structure of the front cover 100 is identical to that of the first embodiment and is not described hear again. The difference between the first and the third embodiments will be detailed below.

In the third embodiment, contrary to the first embodiment, a plurality of hook parts 130 can also be disposed protruding from the edge of the rear cover 200. The hook parts 130 are individually snapped to the slots 230 on the inner side of the surrounding wall 120. At least one hook part 130 is connected to the edge of the rear cover 200 through a flexible arm 134. In the current embodiment, two opposite edges of the rear cover 200 are provided with two hook parts 130 and the hook part 130 at one side is connected to the edge of the rear cover 200 through a flexible arm 134. In practice, the flexible arm 134 extends vertically from the edge of the back plate 210 to the front cover 100 and is reversed to have a U-like shape; the hook part 130 is protruded and formed at a side of one end of the flexible arm 134 to be snapped to the inner side of the surrounding wall 120 of the front cover 100. When the flexible arm 134 is compressed to move the hook part 130 close to the edge of the back plate 210, the hook part 130 can be released from the front cover 100 such that the rear cover 200 can be installed to the front cover 100 or detached from the front cover 100.

The picture frame of the present invention is formed by mutual snapping engagement of the front cover 100 and the rear cover 200 which are both made of plastic. The user just places the painting 10 into the front cover 100 and then snaps the rear cover 200 into the front cover 100 to complete the framing easily and quickly. The picture frame of the present invention, made of plastic, is quite light for easy hanging on the wall 20 through adhesion. Therefore, the wall 20 will not be damaged during the picture frame being hung. In addition, the recess 201 of the rear cover 200 allows the penetration of the hangers 21 for hanging easily and tightly close to the wall 20.

The embodiments described above are only preferred ones of the present invention and are not to limit the scope of the present invention. All the equivalent modifications and variations using the methods, shapes, structures, and apparatus in the specification and figures of the present invention should be embraced by the claimed scope of the present invention.

What is claimed is:

1. A picture frame used to receive a painting, comprising:

a front cover having a front side and a surrounding wall enclosing the front side, wherein the front cover forms a rear opening opposite to the front side, wherein the front side is provided with a window; and a rear cover snapped around the rear opening of the front cover, wherein the rear cover protrudes towards the window to form a rear frame in the front cover, wherein the front cover and the rear frame are used for clamping the painting therebetween and exposing the painting in the window, wherein a plurality of hook parts is disposed protruding from an inner side of the surrounding wall, wherein the hook parts are formed in comb shape and individually snapped to an edge of the rear cover; and wherein the inner side of the surrounding wall and the edge of the rear cover are provided with a first positioning latch and a second positioning latch respectively.

2. The picture frame according to claim 1, wherein the rear cover has a back plate which covers part of the rear opening.

3. The picture frame according to claim 2, wherein the rear frame has an annular shape, wherein a recess is formed in a range encircled by the rear frame on the back plate.

4. The picture frame according to claim 2, wherein an adhesive part is disposed on an outer side of the back plate.

5. The picture frame according to claim 1, wherein the rear cover and the surrounding wall are nested together, wherein the surrounding wall encloses the rear cover.

6. The picture frame according to claim 1, wherein a plurality of slots snapped correspondingly to the hook parts is disposed on the edge of the rear cover.

7. The picture frame according to claim 1, wherein the first positioning latch is formed in L shape and having a latching notch, a height of the latching notch is the same as a height of the second positioning latch.

* * * * *